US005839553A

United States Patent [19]

Dorsam

[11] Patent Number: 5,839,553

[45] Date of Patent: Nov. 24, 1998

[54] BRIEFCASE ORGANIZER

[76] Inventor: Robert E. Dorsam, 1508 Turk Rd., Warrington, Pa. 18976

[21] Appl. No.: 688,636

[22] Filed: Jul. 29, 1996

[51] Int. Cl.[6] ..... A45C 13/02

[52] U.S. Cl. ..... 190/109; 190/110; 190/900; 220/533

[58] Field of Search ..... 190/109, 110, 190/35, 900, 902; 220/23.4, 23.83, 23.86, 532, 533

[56] References Cited

U.S. PATENT DOCUMENTS

| | | | |
|---|---|---|---|
| D. 269,053 | 5/1983 | Castelli | D3/39 |
| D. 300,987 | 5/1989 | Gerch | D3/76 |
| 906,124 | 12/1908 | Fitzgerald | 190/35 |
| 1,143,474 | 6/1915 | Williams | 190/35 |
| 1,867,455 | 7/1932 | Humphrey | 190/110 X |
| 2,187,445 | 1/1940 | Botelho | 190/110 X |
| 3,381,782 | 5/1968 | Ikelheimer | 190/110 X |
| 3,710,900 | 1/1973 | Fink | 190/110 X |
| 4,273,223 | 6/1981 | Tomlinson | 190/110 X |
| 4,591,056 | 5/1986 | Groch | 190/110 X |
| 4,790,434 | 12/1988 | Schoberg et al. | 190/110 X |
| 5,054,668 | 10/1991 | Ricchiuti | 220/533 X |
| 5,160,000 | 11/1992 | Agha et al. | 190/102 |
| 5,190,127 | 3/1993 | Cummings | 190/900 X |

*Primary Examiner*—Jes F. Pascua

[57] ABSTRACT

A briefcase includes a hinge end, an opening end, a first side and a second side. A first case is configured to fit snugly between the hinge end and the opening end of the briefcase, adjacent the first side of the briefcase. A second case is configured to fit snugly between the second side of the briefcase and the first case, adjacent the hinge end of the briefcase, leaving a contiguous open volume for use within the briefcase. A first tray having fixed compartments within for storing items is configured to fit within the first case. A second tray having removable walls forming compartments of variable size is configured to fit within the second case.

2 Claims, 4 Drawing Sheets

BRIEFCASE ORGANIZER

BACKGROUND—FIELD OF INVENTION

This invention relates to organizers, specifically to an organizer of office supplies for use in a briefcase.

BACKGROUND—DESCRIPTION OF PRIOR ART

The business traveler often needs to do various office tasks while on a business trip. This work may be performed at meetings, in hotel rooms, in automobiles or on planes. Typically, the traveler must work from his or her briefcase. The problem arises when the necessary supplies for accomplishing the work at hand are not well organized within the briefcase. Much valuable time is lost looking for the appropriate supplies. Often, one must simply put off finishing a task already begun, because a needed supply can't be found.

What is needed is an organizer for office supplies within a briefcase which holds a wide variety of necessary supplies in an organized, accessible manner. Such an organizer should have an uncluttered, professional looking outward appearance, and should leave ample room within the briefcase for other items, such as notebooks, paper, files, or a lap-top computer.

SUMMARY

The organizer of the present invention includes a briefcase having a hinge end, an opening end, a first side and a second side. A first case is configured to fit snugly between the hinge end and the opening end of the briefcase, adjacent the first side of the briefcase. A second case is configured to fit snugly between the second side of the briefcase and the first case, adjacent the hinge end of the briefcase, leaving a contiguous open volume for use within the briefcase. A first tray having fixed compartments within for storing items is configured to fit within the first case. A second tray having removable walls forming compartments of variable size is configured to fit within the second case.

DESCRIPTION OF DRAWINGS

FIG. 3 is a perspective view of the first case shown in an open position with the first tray removed there-from.

FIG. 5 is a perspective view of the second case shown in an open position with the second tray removed there-from.

DETAILED DESCRIPTION

Figure 1:
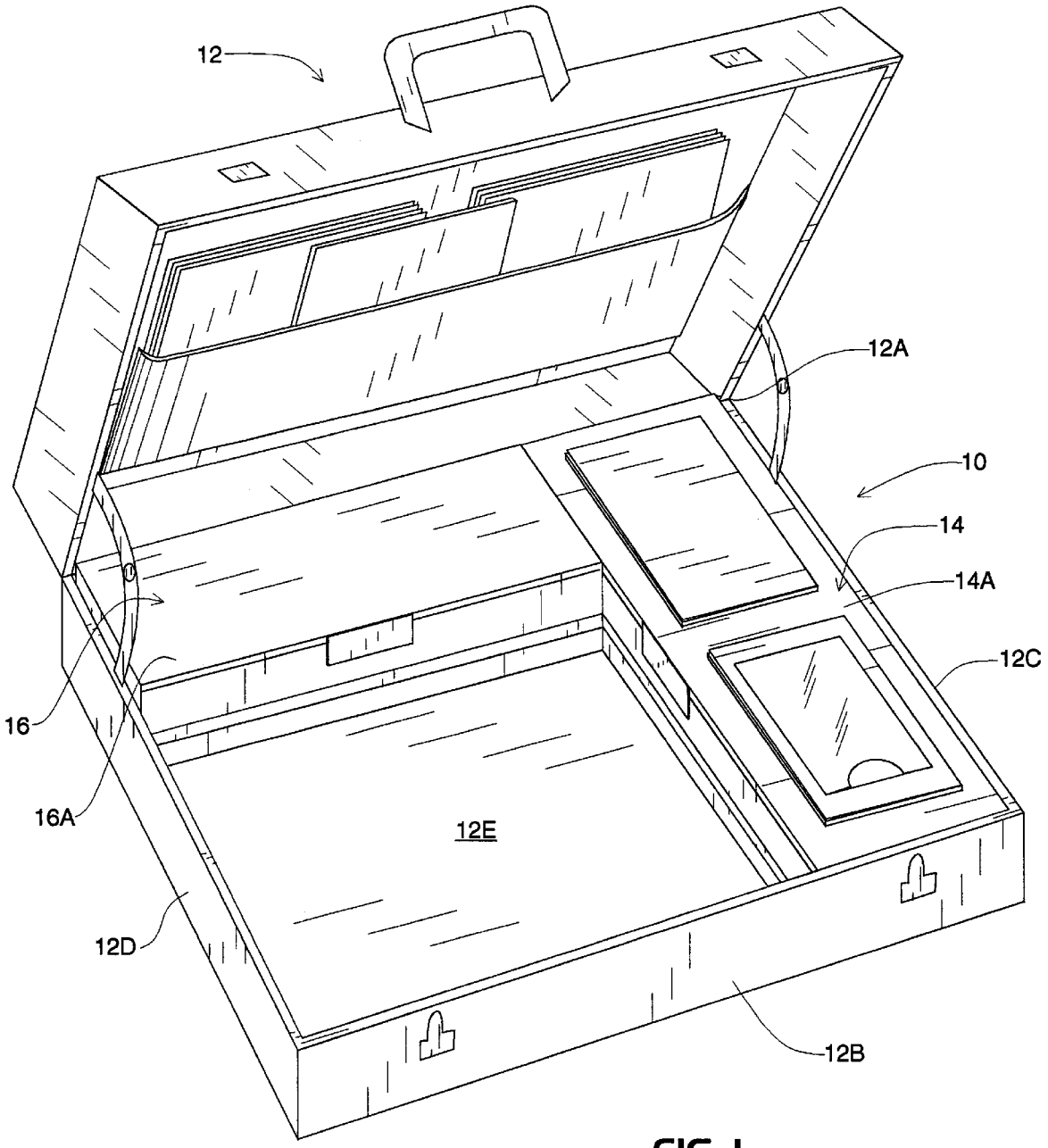
FIG. 1 is a perspective view of the organizer within a briefcase, showing the first case and the second case, each in a closed position.

FIG. 1 is a perspective view of an organizer 10 within a briefcase 12. The organizer 10 comprises a first case 14 and a second case 16, each shown in a closed position in FIG. 1. The first case 14 is substantially box shaped and is configured to fit snugly between a hinge end 12A and an opening end 12B of the briefcase 12. In use, the first case 14 is positioned against a first side 12C of the briefcase 12.

The second case 16 is substantially box shaped and is configured to fit snugly between the first case 14 and a second side 12D of the briefcase 12. In use, the second case 16 is positioned against the hinge end 12A of the briefcase 12.

When the first case 14 and the second case 16 are positioned as shown and described, a contiguous open volume 12E is left for use within the briefcase 12.

The first case 14 includes a hinged lid 14A and the second case 16 includes a hinged lid 16A.

Figure 2:
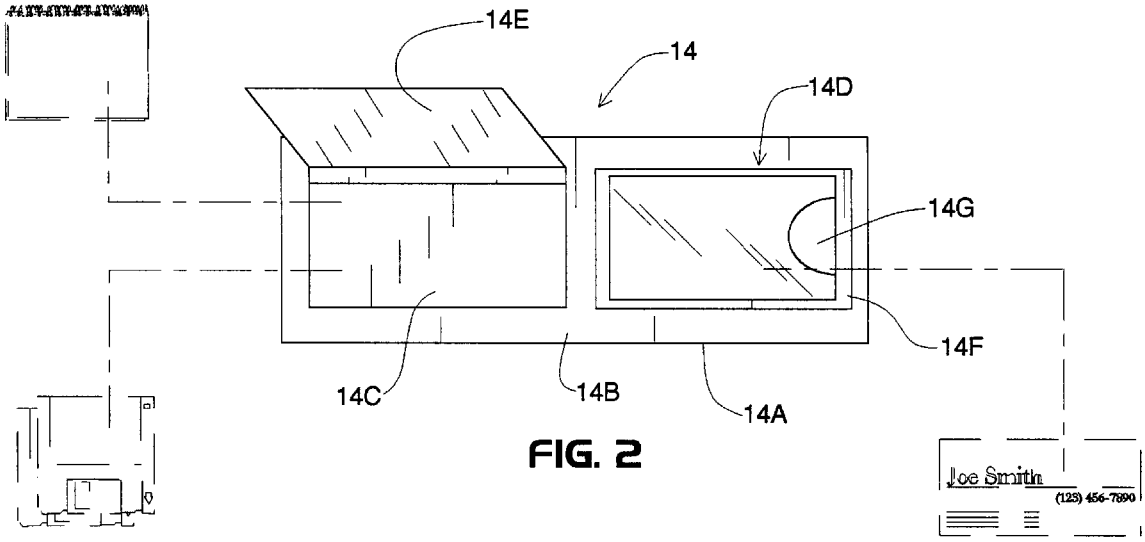
FIG. 2 is a top elevational view of the first case.

FIG. 2 is a top elevational view of the first case 14. Positioned on the top surface 14B of the lid 14A are a first pocket 14C and a second pocket 14D. The first pocket 14C includes a first hinged cover 14E. The second pocket 14D includes a second hinged cover 14F. The second hinged cover 14F is configured substantially the same as the first hinged cover 14E, except for a card holder 14G which is disposed on the second hinged cover 14F. The first and second pockets, 14C, 14D are each sized to hold at least two computer disks 18 or a small note pad 20.

Figure 3:
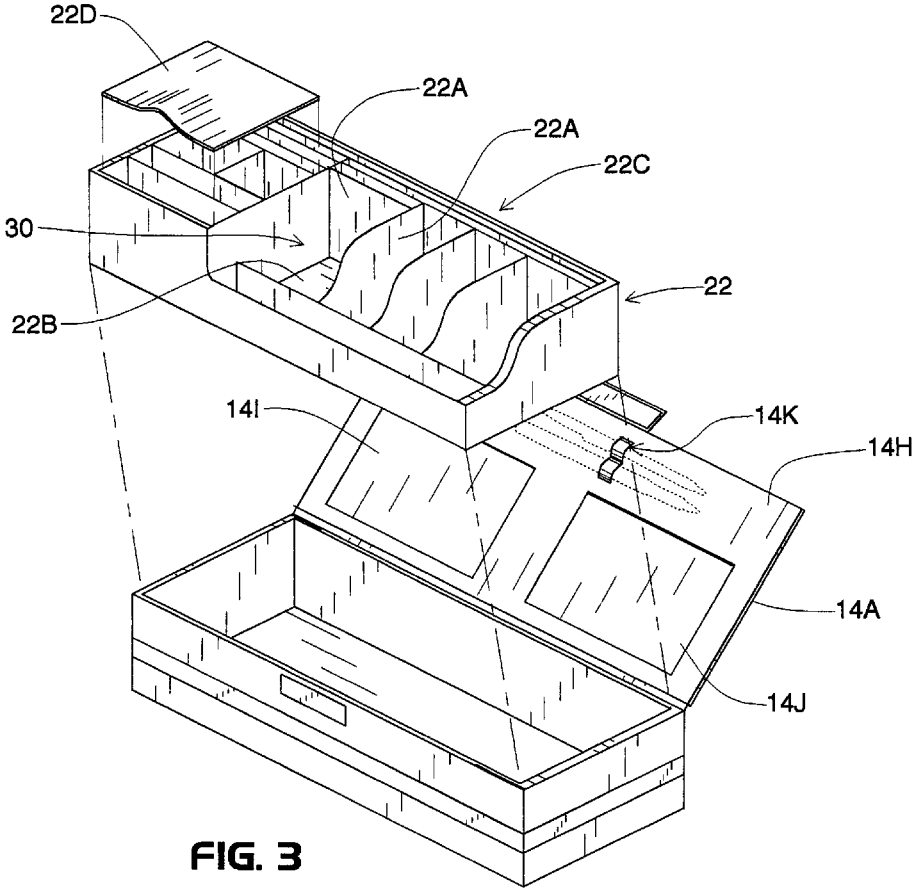

FIG. 3 is a perspective view of the first case 14 shown in an open position with a first tray 22 removed there-from. The inside 14H of the lid 14A includes a third pocket 14I, a fourth pocket 14J and two pen holders 14K disposed thereon. The first tray 22 is generally box shaped and is configured to fit snugly within the first case 14.

The first tray 22 includes a plurality of walls 22A extending at substantially right angles from the bottom 22B there-of, thereby forming a plurality of compartments 30 between the walls 22A. The compartments 30 are generally open and accessible from the top 22C of the first tray 22, except for some of the compartments 30 which include a removable lid 22D.

Figure 4:
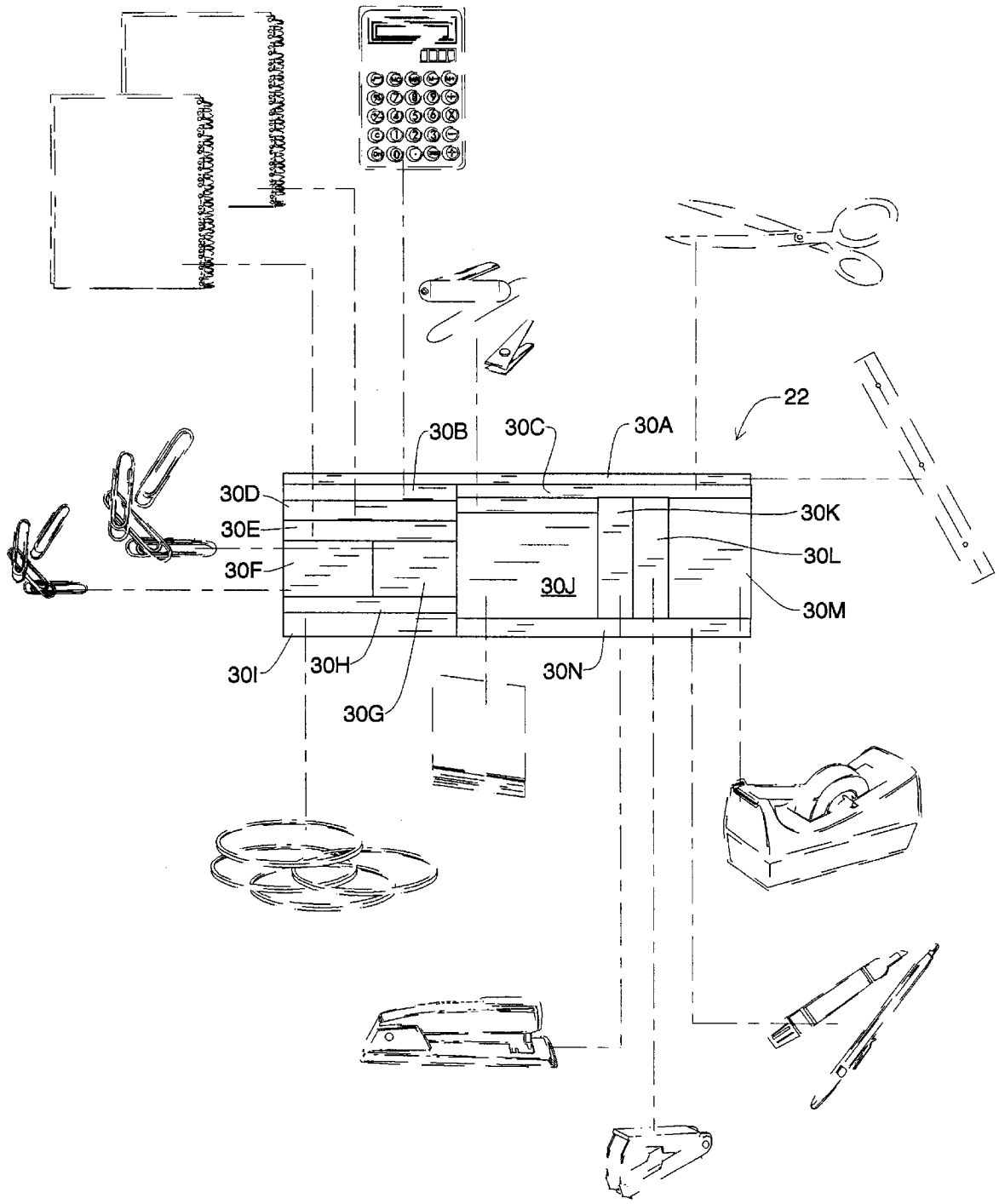
FIG. 4 is a top elevational view of the first tray, illustrating the various office supplies for which the various compartments within the tray are configured.

FIG. 4 is a top elevational view of the first tray 22, illustrating the various office supplies for which the various compartments 30 within the tray 22 are configured. A first compartment 30A is configured to hold a ruler. A second compartment 30B is configured to hold a calculator. A third compartment 30C is configured to hold a scissors. A fourth compartment 30D is configured to hold a phone-address book. A fifth compartment 30E is configured to hold a planning calendar. A sixth compartment 30F is configured to hold small paper clips. A seventh compartment 30G is configured to hold large paper clips. An eighth substantially slender, rectangular box shaped compartment 30H is provided for miscellaneous items. A ninth compartment 30I is configured to hold rubber bands. The lid 22D (FIG. 3) is configured to be placed over the sixth through ninth compartments 30F, 30G, 30H, 30I, because they contain a plurality of small objects which may otherwise easily spill.

A tenth compartment 30J is configured to hold a note pad. An eleventh compartment 30K is configured to hold a stapler. A twelfth compartment 30L is configured to hold a staple remover. A thirteenth compartment 30M is configured to hold a tape dispenser. A fourteenth compartment 30N is configured to hold writing instruments.

Figure 5:
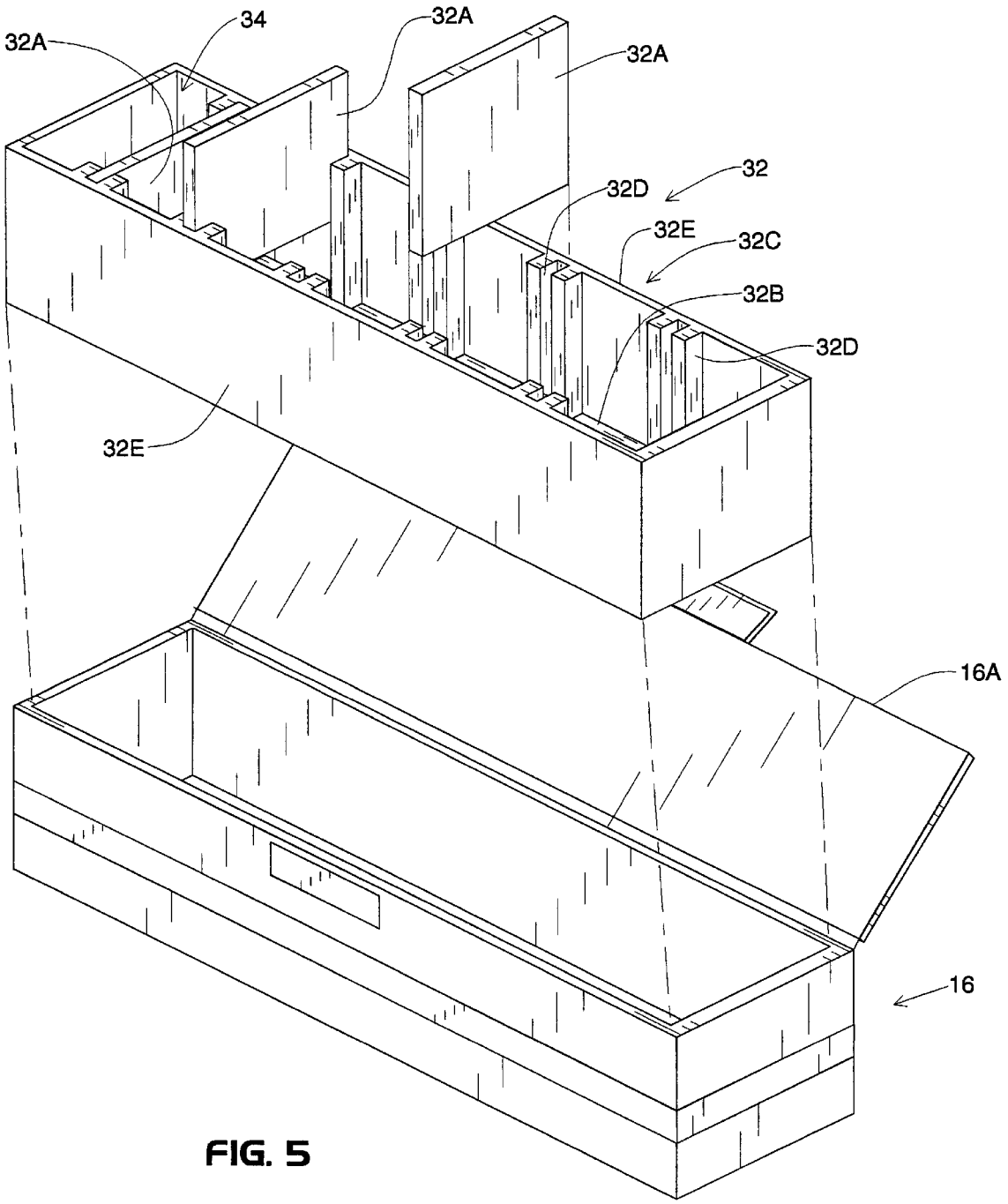

FIG. 5 is a perspective view of the second case 16 shown in an open position with a second tray 32 removed there-from. The second tray 32 is generally box shaped and is configured to fit snugly within the second case 16. The second tray 32 includes a plurality of removable walls 32A extending at substantially right angles from the bottom 32B there-of, thereby forming a plurality of variably sized compartments 34 between the removable walls 32A. The variably sized compartments 34 are generally open and accessible from the upper side 32C of the second tray 32. The removable walls 32A are removably seated within tracks 32D which extend from the bottom 32B to the upper side 32C of the second tray 32. The tracks 32 are positioned on the long walls 32E of the second tray 32, and are disposed in pairs opposing each other.

The variably sized compartments 34 are suitable for personal items such as a collapsible umbrella, a hand mirror, eyeglasses and sunglasses.

The first case 14, the second case 16 may be sold together as an organized briefcase system. This will help to ensure that the cases 14,16 fit snugly within the briefcase 12 as described and shown; however, it is within the scope of the invention that the cases 14, 16 may be manufactured and sold without a briefcase 12, to be used with or without a briefcase 12 at the discretion of the user.

Although the invention has been shown with a substantially hard-walled briefcase 12 and substantially hard-walled cases 14, 16, it is within the scope of the invention that the briefcase 12 or the cases 14, 16 may be made of soft, pliable fabric or leather.

Although the invention has been described with substantially rectangular box shaped cases 14, 16, and trays 22, 32 it is within the scope of the invention that the cases 14, 16 and trays 22, 32 may be of alternative shapes. For example, the shapes may be more rounded, particularly when used in a soft briefcase 12.

It is within the scope of the invention that the latches shown on the briefcase 12 or the cases 14, 16 may be replaced with zippers or any conventional fastening system.

Although it is an object of this invention to provide an organizer which holds office supplies in a very organized, readily accessible manner, the scope of the invention should not be limited to the exact configuration of compartments 30 in the first tray 22 or to the exact configuration of tracks 32D in the second tray 32.

Thus the organizer of the present invention holds a wide variety of necessary office supplies in an organized, accessible manner, presents a clean and uncluttered outward appearance, and leaves ample room for other needed articles within the briefcase.

While the above description contains many specific details, these should not be construed as limitations on the scope of the invention, but rather as an exemplification of various embodiments thereof.

Accordingly, the scope of the invention should be determined not by the embodiments illustrated, but by the appended claims and their legal equivalents.

The invention claimed is:

1. An apparatus for organizing items, comprising:

a. a briefcase having a hinge end, an opening end, a first side and a second side;

b. a first case configured to fit snugly between the hinge end and the opening end of the briefcase, adjacent the first side of the briefcase;

c. a second case configured to fit snugly between the second side of the briefcase and the first case, adjacent the hinge end of the briefcase, leaving a contiguous open volume for use within the briefcase;

d. a first tray configured to fit within the first case, the first tray having fixed compartments within for storing such items; and e. a second tray configured to fit within the second case, the second tray having a variable compartmentalization means within for storing such items.

2. The apparatus of claim 1, wherein the first case and the second case each include a covering means for concealing the first and second trays, respectively.

* * * * *